US006427384B1

(12) United States Patent
Davis, Jr.

(10) Patent No.: US 6,427,384 B1
(45) Date of Patent: Aug. 6, 2002

(54) AUTOMATIC HATCH COVER FOR BULK CARRIERS

(76) Inventor: James Robert Davis, Jr., 2642 Webb Rd., Bel Arthur, NC (US) 27811

( * ) Notice: Subject to any disclaimer, the term of this patent is extended or adjusted under 35 U.S.C. 154(b) by 0 days.

(21) Appl. No.: 09/373,890

(22) Filed: Aug. 12, 1999

(51) Int. Cl.[7] ..... E05F 7/02
(52) U.S. Cl. ..... 49/255; 49/258
(58) Field of Search ..... 49/254, 255, 256, 49/258, 259

(56) References Cited

U.S. PATENT DOCUMENTS 2,955,452 A * 10/1960 Myers ..... 49/255 X
3,067,986 A * 12/1962 Grantham ..... 49/254 X
3,888,045 A * 6/1975 Piegza ..... 49/255
4,334,633 A * 6/1982 Piegza ..... 49/255 X
5,919,421 A * 7/1999 Monz et al. ..... 49/254 X

FOREIGN PATENT DOCUMENTS

DE 2812020 * 9/1979 ..... 49/255

* cited by examiner

*Primary Examiner*—Jerry Redman
(74) *Attorney, Agent, or Firm*—Mills Law Firm PLLC

(57) ABSTRACT

A hatch closure system for loading of material through a top hatch into a mobile or stationary pressurized carrier includes a support frame pivotally attached to carrier for actuated movement between an loading position wherein said support frame is located remote from said hatch and a closure position overlying hatch, a cover carried by the frame member for actuated movement between a raised unsealed position above the hatch and a lowered sealed position engaging the hatch, and a locking member having a latched condition maintaining the sealed position and an unlatched position permitting movement of the hatch to the raised position.

2 Claims, 5 Drawing Sheets

AUTOMATIC HATCH COVER FOR BULK CARRIERS

FIELD OF THE INVENTION

The present invention relates to storage tanks and, in particular, to a hatch cover system for bulk carriers.

BACKGROUND OF THE INVENTION

Dry bulk carriers are typically used to transport dry particulates, such as dry granular bulk cement, and will be described with reference to mobile units commonly known as dry bulk transports. Therein, a mobile storage unit transported by a tractor includes a main pressure reservoir for loading, holding, and unloading material. The material is loaded through a hatch on the top of the reservoir. After loading, the hatch is mechanically closed and sealed. For unloading, a pneumatic system is used to pressurize the reservoir and discharge the material through discharge openings in the bottom of the reservoir. According, the hatch system for such units must provide a plurality of distinct functions. First the hatch must open for the delivery of contents. Second, the hatch must close securely for transport. Third, the hatch must be securely sealed for operation of the pneumatic discharge system.

Conventional hatches for such storage reservoirs typically provide a cylindrical sleeve defining a cylindrical port at the top of the unit. A hatch cover is pivotally connected to the sleeve for movement between an open position for loading and a closed position for latching, sealing and delivery. The hatch cover generally carries an annular seal that establishes an interface between the sleeve and the hatch cover. A plurality of over-center levers are circumferentially disposed about the sleeve and pivotally connected thereto. The levers include an offset cam surface that engages the top of the cover and upon inward rotation engages the periphery of the cover and downwardly biases the cover to compress the sealing interface. At the delivery site, the above procedure is reversed, the levers being disengaged and the hatch cover pivoted to the open position.

With such hatch cover system, the loader, typically the vehicle driver, must vertically climb a ladder on the reservoir leading to the cover. Oftentimes, such covers are located a substantial distance above ground. Such reservoirs also typically have a curved upper surface adjacent the hatch. Accordingly, the loader must assume a position thereat and exert substantial force to unlock the levers and pivot the cover, which can weigh between 20 to 40 pounds. In addition to the substantial time to accomplish the above activities, the same must be done in precarious positions during various types of inclement weather, excessive heat and cold, rain, snow, sleet and wind.

As should be apparent, conventional hatch cover system require inordinate loading and unloading time and effort and pose substantial risks to the workers under operating conditions. One approach for providing a lower level operator platform for accessing the hatch is disclosed in U.S. Pat. No. 5,538,286 to Hoff wherein a platform is positioned intermediate a pair of pressure vessels and requires that the hatches be offset from the top of the vessels. Such platforms and offset are not usable in conventional bulk transports wherein a single elongated tank is employed and optimum storage capacity obtained with the hatch located at the top of the transport. Accordingly, a need exists for a hatch cover system that decreases the time required for loading the transport units, simplifies the latching procedure and reduces the safety risks to the operator.

SUMMARY OF THE INVENTION

The present invention provides a ground level operated load and latch system for mobile and stationary pneumatic storage reservoirs that reduces associated operator filling time and enables the filling of the reservoir under all conditions without the operator risks set forth above.

The present hatch cover system is specifically desireable for dry bulk transports of the type having a upwardly opening hatch communicating with a storage vessel through which the cargo material is loaded. A hatch cover has an upper annular sealing surface for engaging the hatch. The cover is raised and lowered by a lifting pneumatic actuator carried on a support frame that pivots about a vertical axis. A lock bar is shifted by a pneumatic locking actuator between a locked position interposed between the support frame and the cover to maintain a compressive sealing interface for transportation and pressurization of the reservoir. The lock bar is shifted by the locking actuator to an unlocked position to permit raising and lowering of the cover. A pivoting actuator moves the support frame and the cover between the raised position overlying the hatch and an open position remote from the hatch for loading and maintenance. The control system for the actuators is conveniently located at ground level enabling the operator to view easily the operation of the hatch closure system.

Accordingly, it is an object of the present invention to provide an automatic closure system for the hatch of a bulk carrier that can be operated at ground level without requiring the operator to climb atop the carrier body.

Another object of the invention is to provide a hatch closure system for the hatch of a dry bulk transport that can be selectively remotely actuated to provide pressure sealing of the hatch and a fully open position for loading and maintenance.

A further object of the invention is to provide an automatic hatch closure system for a mobile pneumatic bulk carrier wherein the hatch cover may be remotely controlled to provide unobstructed loading of the carrier reservoir and shifted to a securely closed and locked condition for transportation, delivery and maintenance.

DESCRIPTION OF THE DRAWINGS

The above and other features, objects and advantages of the present invention will become apparent upon reading the following detailed description taken in conjunction with the accompanying drawings in which.

DETAILED DESCRIPTION OF THE PREFERRED EMBODIMENTS

Figure 1:
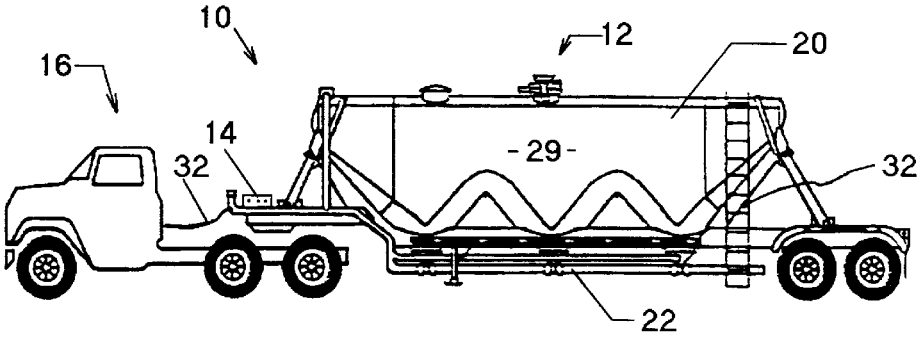
FIG. 1 is a side elevational view of a mobile bulk carrier provided with an automatic hatch closure system in accordance with a preferred embodiment of the invention.

Referring to the drawings for the purpose of illustrating a preferred embodiment and not for limiting same, FIG. 1 shows a mobile bulk transport carrier 10 having an automatic hatch system 12 operated at a ground-level control panel 14. As is conventional, the bulk carrier 10 is transported by a tractor 16 for loading bulk dry material, such as cement, therein at a loading station, transporting the material for to a destination site, and unloading the material at the destination site. As will become apparent, the hatch system 12 is well suited for mobile applications and in particular pneumatically assisted unloading of the material. However, it will be appreciated that the hatch system may also be beneficially used in conjunction with stationary storage units.

The carrier 10 comprises an outer body 20 having a conventional delivery or discharge system 22 at the bottom thereof and a cylindrical top manhole or hatch 24 in the form of an upwardly opening cylindrical sleeve 26 defining a circular loading port 28 communicating with the interior reservoir 29 of the body 20. Conventionally, the hatch 22 is located mid-length of the body 20 and on the longitudinal centerline 30 thereof. The carrier 10 may include a second hatch 31 that may also be equipped with the hatch system.

The carriers 10 carry substantial quantities of cargo material and consequently the top surface of the body is oftentimes 10 to 12 feet above the road surface. Operator access to the top is afforded by a side mounted ladder 32 adjacent the rear wheels. The control panel 14 is located at ground level adjacent the front wheels of the tractor 16, generally 3 to 5 feet above the road surface, and with convenient access to the main air line 32 from therefrom. At such position the operator may view the operation of the hatch system as described below.

The present invention will be referenced to a single hatch unit having a standard hatch sleeve of around 20 inches. Referring to FIGS. 2–6, the sleeve 26 projects upwardly from the top surface of the body. The sleeve 26 has, for purpose of reference, a vertical axis 36. The top surface of the sleeve 26 lies in a horizontal plane and defines a circular annular sealing surface 40. The present invention provides an automatic closure mechanism for sealing the surface 40 by closing the port and allowing pressurization of the reservoir 29 for pneumatically assisted unloading and for fully exposing the port for the loading of material by conventional, material specific apparatus, not shown.

Figure 7:
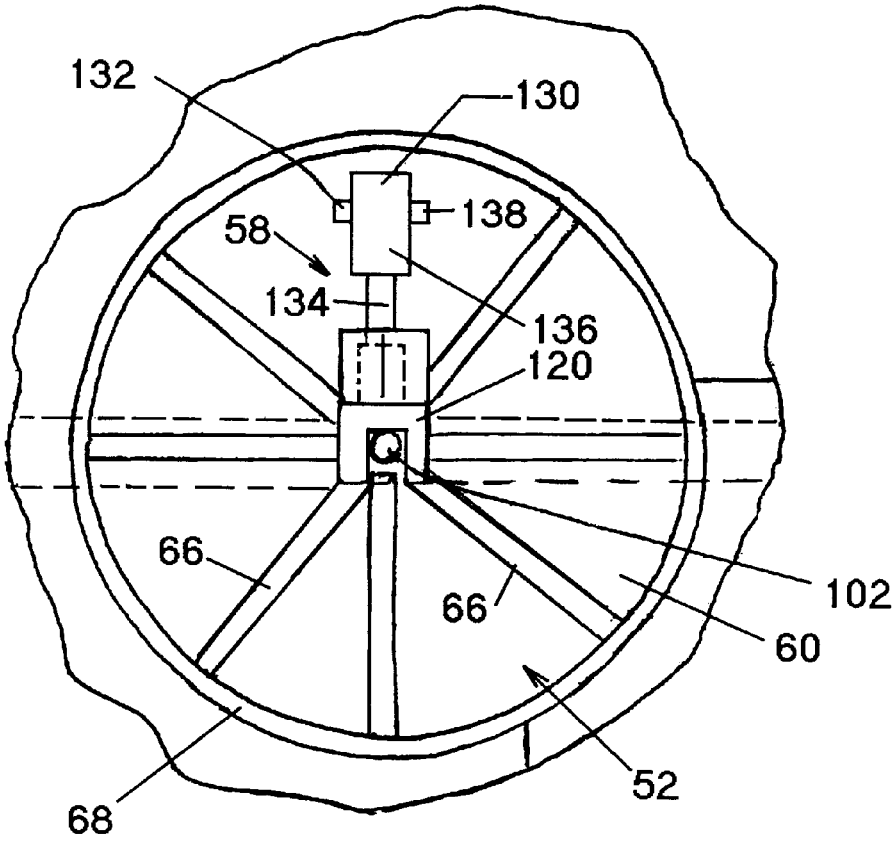
FIG. 7 is an enlarged fragmentary view taken along line 7—7 in FIG. 4 showing the hatch in the closed and locked position.
Figure 8:
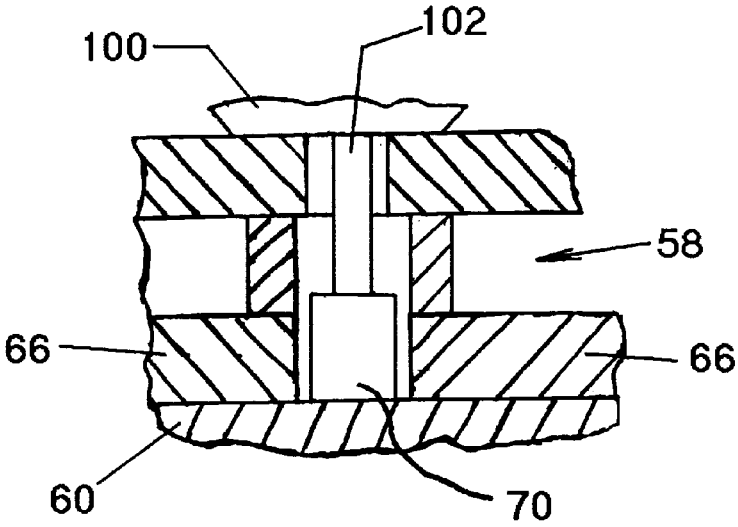
FIG. 8 is an enlarged fragmentary view taken along line 8—8 in FIG. 7 showing the hatch in the locked position.

The hatch system 12 comprises a support frame 50, a hatch cover 52, a lifting assembly 54, a pivot assembly 56 and a locking assembly 58 as shown in FIGS. 7 and 8. As hereinafter described in detail, the cover 52 is raised and lowed from the sealing surface by the lifting assembly 54, pivoted between closed and open positions by the pivoting assembly 56, and locked in sealing engagement over the port by the locking assembly 58.

Figure 6:
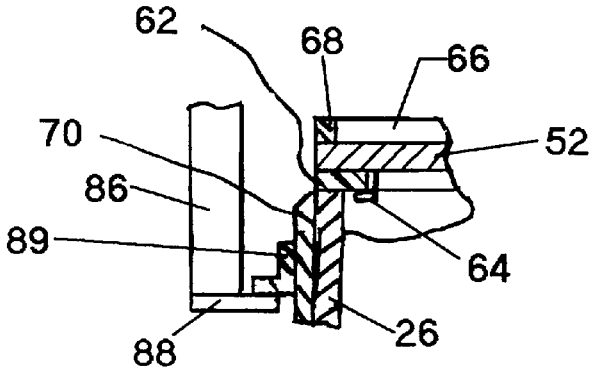
FIG. 6 is an enlarged fragmentary cross sectional view taken along line 6—6 in FIG. 2 showing the sealing interface in the closed position.

The hatch cover 52 has a generally circular body 60. As shown in FIG. 6, he lower surface of the body 60 carries a sealing ring 62 for engaging the sealing surface 40 of the port 28 and establishing a compressive pressure seal between the cover 52 and the hatch sleeve 26. The sealing ring 62 is held in position on the lower surface of the body 60 by a plurality of circumferentially spaced retainers 64. While the sealing ring 62 is illustrated as an annular gasket, other sealing members of varying shape and material may be utilized.

To provide circumferential structural integrity at the interface in the presence of the applied sealing loadings, the top surface of the body 60 includes a plurality of radially disposed webs 66 and an outer annular stiffening ring 68. This reinforced construction assists in maintaining the planarity of the sealing interface under clamping and pressurized conditions.

Figure 10:
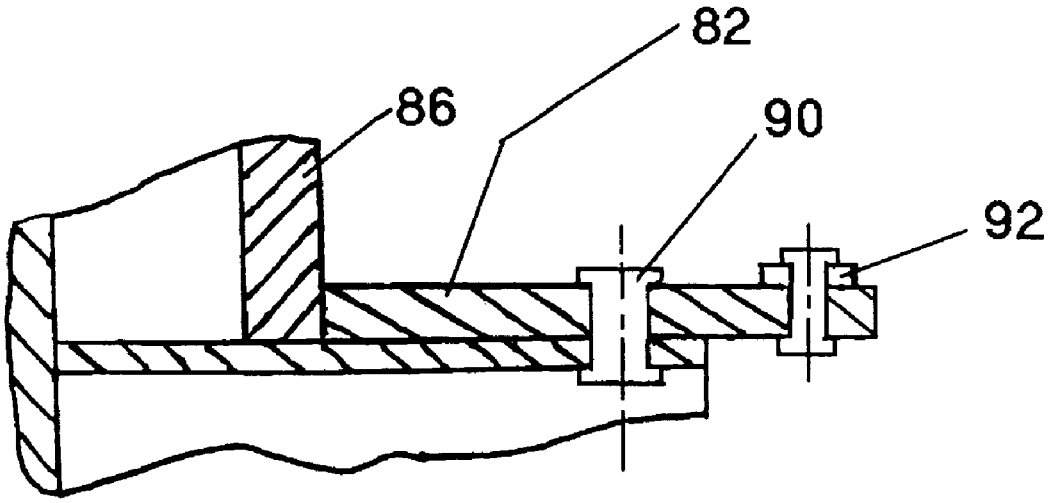
FIG. 10 is an enlarged fragmentary view taken along line 10—10 in FIG. 2.

The support frame 50 comprises an support sleeve 70, a mounting plate 72, and a pivot frame 74. The support sleeve 70 is cylindrical and telescopically received over the sleeve 26 and mechanically connected thereto, preferably by welding. The mounting plate 72 is horizontally disposed and connected to the frontal side wall of the sleeve 70 at the inner side thereof and supported at the body by a downwardly depending bracket 76. The pivot frame 74 includes a generally U-shaped lifting bracket 80 and an outwardly extending pivot arm 82. The lifting bracket 80 includes a horizontal lifting arm 84 vertically spaced above the cover 53 and a pair of downwardly extending legs 86, 88 spaced in the closed position on diametrically opposed sides of the sleeve 70. The outer leg 86 includes an inwardly extending foot 88 that engages a stop plate 89 connected to the sleeve 70 for resisting applied loads on the frame in the sealed position of the hatch. Referring to FIG. 10, the pivot arm 82 extends outwardly from the lower end of the arm 86 vertically above the support plate. The pivot arm 82 is pivotally connected to the support plate 72 at pin connection 90 and is pivotable thereabout between the open and closed position of the hatch system. Outboard of the pivot connection 90 on the arm, a second pivot connection 92 is provided for connection with the pivoting actuator as described below.

The lifting assembly includes a spring biased diaphragm actuator 100 mounted on the lifting arm 84 having an actuator rod 102 depending downwardly through a hole therein. The body 104 of the actuator 100 is mechanically or otherwise secured to the support arm 84. The lower end of the actuator rod 102 is connected to the block 70 fixedly mounted on the cover 60. One internal chamber in the actuator 100 is connected to a pneumatic line 106 leading to the control panel 14. In the closed position, the actuator chamber is vented and an internal actuator spring, not shown, biases the actuator rod 102 downwardly effecting the compressive sealing engagement between the cover 60 and the hatch sealing surface 40. In the pressurized condition, the chamber is pressurized and the applied forces overcome the spring biasing thereby upwardly shifting the rod 102 and accordingly moving the cover 60 to a raised position sufficiently above the hatch to allow pivoting thereof to a loading position hereinafter described. A pair of counterbalance springs 108 are interconnected between the support arm 84 and the cover 60 for assisting in the movement to the raised position.

Figure 2:
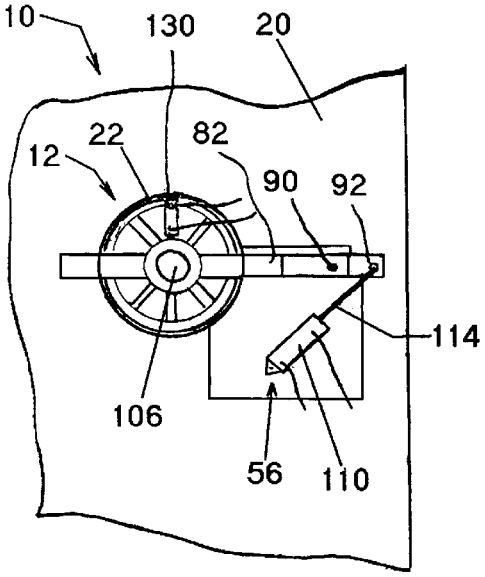
FIG. 2 is a fragmentary plan view of the hatch closure system in the closed and locked position.
Figure 3:
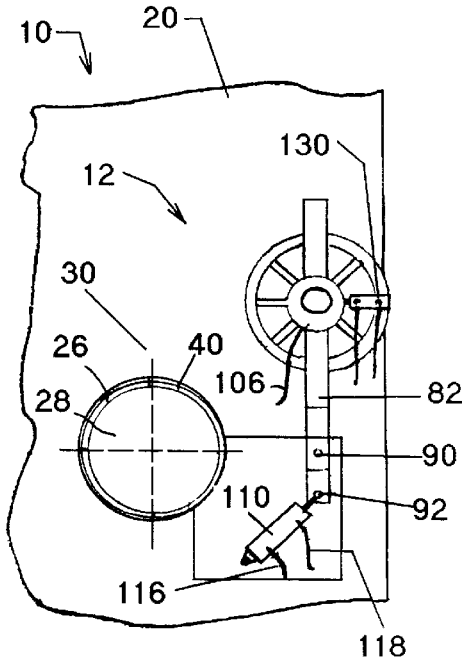
FIG. 3 is a fragmentary plan view of the hatch closure system in the open position.
Figure 4:
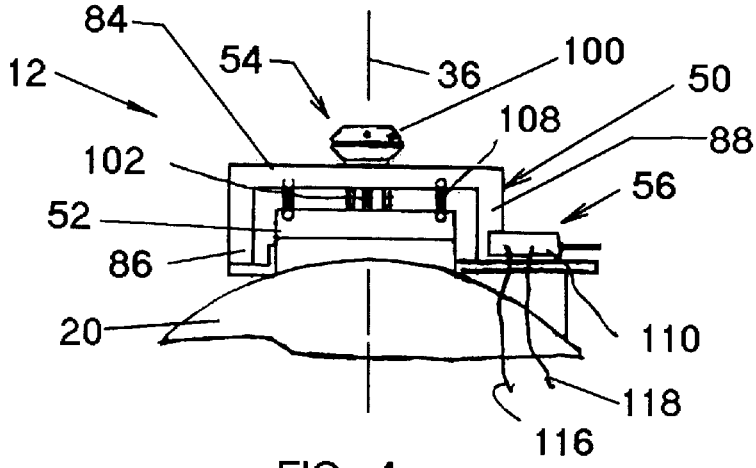
FIG. 4 is a fragmentary front view of the hatch closure system in the closed and locked position.

The pivoting assembly includes a two-way pneumatic pivoting actuator 110. The actuator 110 is pivotally connected at the end of the cylinder body to the mounting plate 72 and includes a piston rod 114 having an end operatively connected to the pivot arm 82 at pin connection 92. The actuator 110 is conventionally connected to the control panel 14 by air lines 116, 118. In the extended actuated position, the pivoting actuator 110 pivots the support frame about the pin connection 90 to position the cover 60 in the closed position overlying the hatch 22 as shown in FIG. 2. In the retracted position, the actuator 110 pivots the support frame clockwise about the pin connection 90 to position the cover 60 remote from the hatch 22 in an open or loading position for receipt of material, as shown in FIG. 3.

Referring additionally to FIGS. 7 and 8, for the latching of the cover, a U-shaped lock member 120 is interposed between the support arm 84 of the support frame and the webs 66 on the top surface of the cover 60. The lock member 120 is shifted between the latched condition, shown in the solid lines, and the unlatched condition, shown in the dashed lines, by a two-way pneumatic actuator 130. The cylinder of the actuator 130 is attached to the outer perimeter of the cover 60 by brackets 132. The piston rod 134 of the actuator 130 is connected at an outer end to the lock member 120. Pneumatic lines 136, 138 lead from the cylinder to the control panel 14 as described below. With the lock member 120 in the latched condition, upward movement of the cover 60 out of sealing engagement is prevented. In the retracted unlatched condition, the raising of the cover by actuator 100 is enabled.

Figure 5:
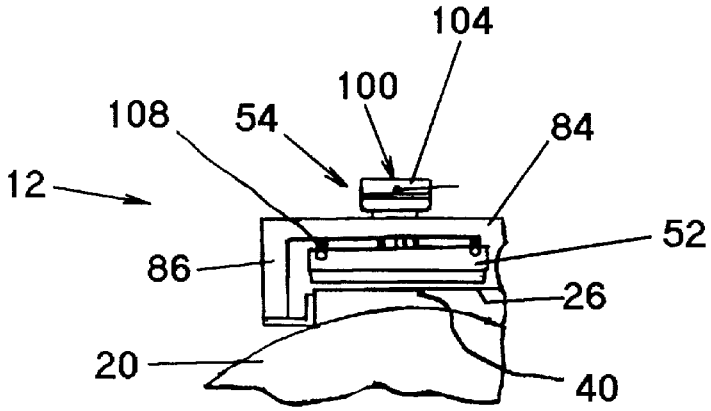
FIG. 5 is a fragmentary front view of the hatch closure system in the open and unlocked position.
Figure 9:
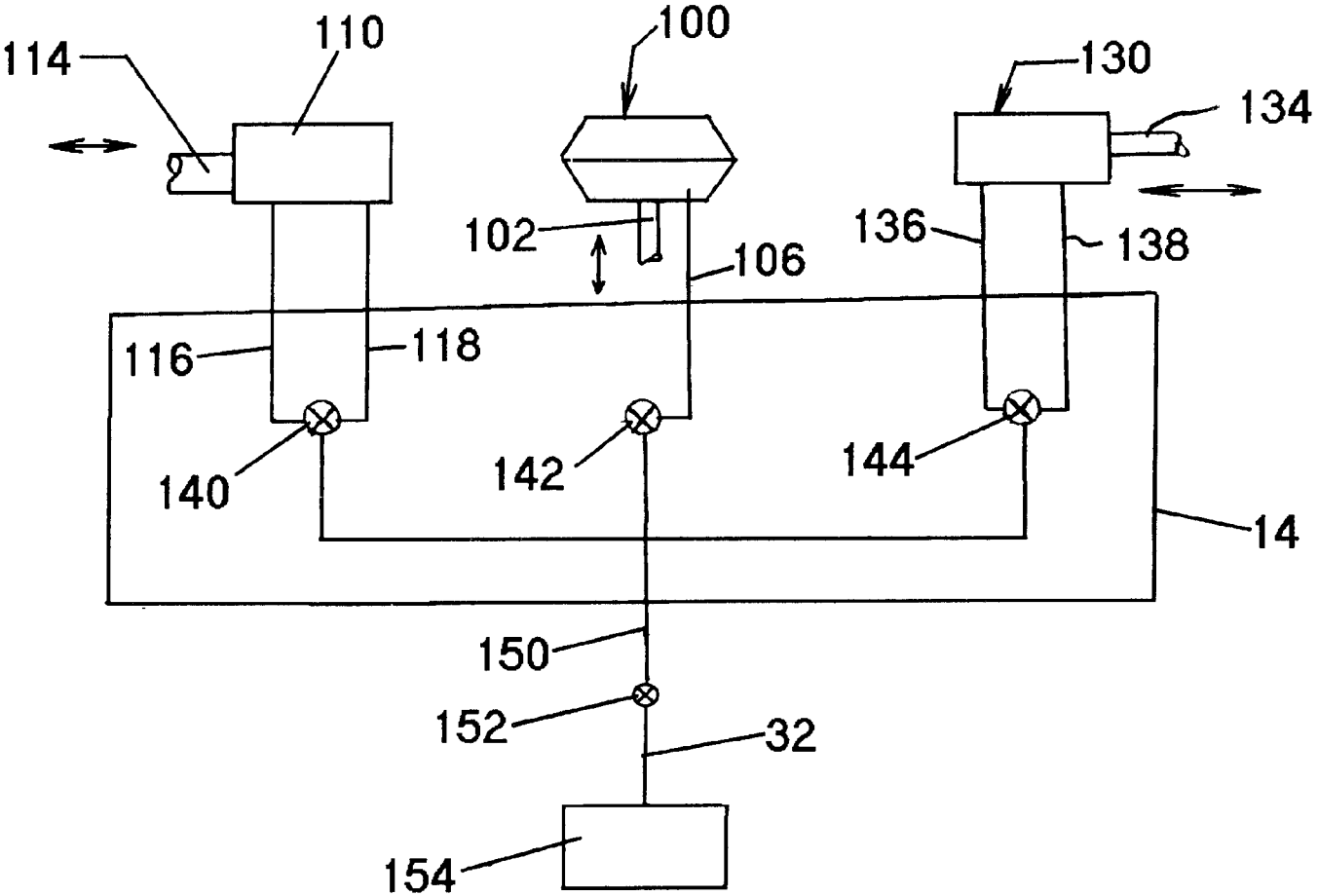
FIG. 9 is a schematic view of the control system for the hatch closure system.

Referring additionally to FIG. 9, the control system for the hatch system is located as a module in the control panel 14 and comprises a pivot valve 140, a two-way lift valve 142, and a two-way lock valve 144. The valves 140, 142, and 144 are connected by supply line 150 to shut off valve 152, which is connected by main air line 32 to the tractor air supply 154. After positioning appropriately for the filling system, the operator actuates lock valve 144 to the unlock position thereby retracting the piston rod 134 of actuator 130 and shifting the lock member 120 out of engagement between the support arm and the cover 60. During the filling operation, the lock valve 144 may be returned to the neutral position or left energized until loading is completed and the closing sequence commenced. Thereafter, the lift valve 142 is opened causing the rod 102 along with the associated cover 60 to rise vertically against the biasing of the internal spring to the lifted position spaced from the interface as shown in FIG. 5. Preferably, the lift actuator 100 remains energized until completion of reloading and resealing. After the cover 60 is raised, the pivot valve 140 is shifted to the open position thereby retracting the piston rod 114 of actuator 110 and pivoting the support frame about the pin connection 90 to the illustrated open position remote from the hatch so as not to interfere with the filling operation. The valve 140 may remain in the open position awaiting reloading completion or be placed in the neutral position.

Upon completion of the filling operation, the aforementioned sequences are reversed. First the pivot valve is moved to the close position whereby the support frame is pivoted to a position overlying the hatch and thereafter to the off position. Second, the lift valve is closed to vent the actuator chamber whereby the actuator spring and weight of the cover biases the cover into sealing engagement with the hatch. Third, the lock valve is shifted to the lock position thereby extending the piston and interposing the lock member 120 between the support arm 84 and the cover 60 thereby maintaining the sealing integrity of the hatch closure. Upon completion of the latching, all valves are returned to the off position.

The present control system has been described with reference to independently operable valves. However, it will be apparent the valves may be interconnected to prescribe a mandatory sequence using proximity sensors or the like associated pneumatic circuitry. Moreover, status lights and master control valves may also be employed.

While the present invention has been described with reference to the preferred embodiment above, other modifications and improvements thereto will become apparent. Accordingly, the invention is to be determined solely with reference to the following claims.

What is claimed:

1. A hatch closure system for a storage tank having a upwardly opening hatch communicating with a storage volume for loading of material to be transported, said hatch having an upper annular sealing surface defined about a vertical axis, said hatch closure system comprising: a support bracket adapted to be attached to said tank; a support frame having a horizontal member; pivot means connecting said support bracket and said support frame for accommodating pivotal movement of said support frame about a vertical axis between an loading position wherein said support frame is located remote from said hatch and a closure position wherein said horizontal member of said support frame overlies said hatch;

first actuator means operatively connected to said support frame and said support bracket for pivoting said support frame between said loading position and said closure position;

a cover member having a lower surface including sealing means engagable with said sealing surface;

second actuator means carried by said horizontal member and operatively connected to said cover member, said second actuator means effective for moving said cover member between a raised position vertically above said sealing surface and a lowered position wherein said sealing means is in compressive sealing engagement with said sealing surface;

locks means coacting with said support frame and said cover member in a locked condition for maintaining said sealing means in said lowered position in said compressive sealing engagement with said sealing surface and an unlocked condition permitting vertical movement of said cover member to said raised position; and third actuator means for moving said lock means between said locked condition and said unlocked condition.

2. An automatic closure system for a pressurized storage container having a body defining a reservoir for the loading of material through a cylindrical port having an upwardly sleeve terminating with an annular interface, said automatic closure system comprising:

frame means adapted to be pivotally connected at bracket means to the body for pivotal movement about an axis parallel to said port between a first position and a second position, said frame means having horizontal member overlying said sealing interface in said first position and remote from said sealing interface in said second position;

a first actuator operatively connected with said frame means for moving said frame means between said first position and said second position;

a cover member having a lower surface including a sealing member engagable with said annular interface;

a second actuator carried by said horizontal member of said frame means and operatively connected to an upper surface of said cover member, said second actuator means effective for moving said cover member between a raised position vertically above said annular interface and a lowered position wherein said sealing means is in compressive sealing engagement with said annular interface;

means coacting with said frame means and said cover member in a locked condition for maintaining said sealing member in said lowered position in said compressive sealing engagement with said annular interface and an unlocked condition permitting vertical movement of said cover member to said raised position; and a third actuator for moving said lock means between said locked condition and said unlocked condition.

* * * * *